US006886354B2

(12) United States Patent
Dudley

(10) Patent No.: US 6,886,354 B2
(45) Date of Patent: May 3, 2005

(54) COMPRESSOR PROTECTION FROM LIQUID HAZARDS

(75) Inventor: Kevin F. Dudley, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 100 days.

(21) Appl. No.: 10/407,377

(22) Filed: Apr. 4, 2003

(65) Prior Publication Data

US 2004/0194485 A1 Oct. 7, 2004

(51) Int. Cl.[7] ..... F25B 31/00

(52) U.S. Cl. ..... 62/193; 62/472; 417/13; 417/281

(58) Field of Search ..... 62/193, 192, 84, 62/472, 470, 471, 228.5; 417/13, 279, 281

(56) References Cited

U.S. PATENT DOCUMENTS 3,577,741 A * 5/1971 Shaw ..... 62/84
3,766,747 A * 10/1973 Parker ..... 62/226
5,062,277 A * 11/1991 Heitmann et al. ..... 62/193
5,252,036 A * 10/1993 Bunch et al. ..... 417/313
5,327,997 A * 7/1994 Nash et al. ..... 184/6.4
6,302,654 B1 * 10/2001 Millet et al. ..... 417/63
2003/0077179 A1 * 4/2003 Collins et al. ..... 417/63

FOREIGN PATENT DOCUMENTS

GB 2219661 A 12/1989

OTHER PUBLICATIONS

James Solberg, Norman R. Miller and Predrag Hrnjak "A Sensor for Estimating the Liquid Mass Fraction of the Refrigerant Exiting an Evaporator" Society of Automotive Engineers, Paper 2000–01–0976, 2000.

* cited by examiner

*Primary Examiner*—Marc Norman

(57) ABSTRACT

Two liquid levels are sensed in the oil sump of a compressor to determine if sufficient oil and excess refrigerant are present prior to starting the compressor and appropriate steps taken, if necessary. At start-up, and during operation, the presence or flow of liquid refrigerant in the suction of the compressor is sensed and appropriate steps taken, if necessary.

12 Claims, 8 Drawing Sheets

COMPRESSOR PROTECTION FROM LIQUID HAZARDS

BACKGROUND OF THE INVENTION

In an inactive air conditioning, heat pump, or refrigeration system, pressure equalization takes place and refrigerant tends to condense and collect at cool and/or low locations in the system. For the range of indoor and outdoor temperatures encountered in many systems during the off-portions of their cycles, the compressor is often the coolest part of the system for some period of time. As a result, considerable liquid refrigerant may collect in both suction-side and discharge-side portions of the compressor.

Liquid refrigerant that collects in the compressor oil sump produces a raising of the liquid level but dilutes the oil, reducing its ability to lubricate compressor bearings and other moving parts when the compressor is started. Liquid refrigerant that condenses on the suction side of the compressor may be drawn into the compression mechanism at start-up resulting in a flooded start. Since the liquid is essentially incompressible, its presence can result in very high pressures and stresses in the compressor. Lesser amounts of liquid refrigerant can wash away lubrication oil films normally present on moving parts. Liquid that condenses on the suction side may also be delivered directly or indirectly into the compressor oil sump at start-up, thereby diluting oil with the possible consequences described above.

Because of the affinity between refrigerants and many of the lubricants used therewith, refrigerant may also migrate to, and dissolve into, the oil over time even when the compressor is not any cooler than other portions of the system, thereby contributing to oil dilution and attendant loss of lubricating ability. This affinity also results in oil being removed from the sump and distributed throughout the system by the refrigerant in circulating through the system.

In operation of the system, the greatest heat transfer occurs in the evaporator due to phase change of the refrigerant from liquid to gas. The expansion device controls the flow and pressure drop of the refrigerant entering the evaporator. While superheated refrigerant normally flows from the evaporator to the compressor, if the expansion device does not properly function and/or if insufficient heat is available to achieve complete evaporation of the refrigerant, liquid refrigerant may be supplied to the suction of the compressor. Liquid refrigerant may also be supplied to the compressor if the system is overcharged with refrigerant. Lubrication failure, flooded starts, liquid refrigerant flooding and slugging can each cause compressor failure.

SUMMARY OF THE INVENTION lubrication failure and/or liquid hazards such as flooding, slugging and flooded starts is reduced, if not eliminated, by the present invention. The lack of sufficient lubricant can be determined through a low liquid level sensor in the compressor sump. The presence of excess refrigerant present as liquid refrigerant or as a diluent of the oil can each be detected through a sensor located at a level requiring a volume of oil in excess of design specifications due to the presence of refrigerant in the oil. The flow of liquid refrigerant into the compressor can be detected by a sensor located in the suction flow path for detecting liquid refrigerant mass flow. The same type of sensor may be used to detect high and low liquid levels and liquid flow to the compressor.

In response to a call for cooling, the presence of sufficient oil and the absence of excessive refrigerant would permit the starting of the compressor. If insufficient oil is present the system would not be enabled. If excess liquid refrigerant is present in the sump or suction inlet of the compressor, a crankcase heater would be enabled to heat the liquid in the sump and suction inlet to drive off the refrigerant and increase the percentage of oil in the sump. After heating the oil in the sump for a predetermined time, the sensors would sense the liquid level and the compressor will be started if the liquid level is between the two sensors. During the operation of the system the flow of liquid refrigerant into the compressor will be sensed and the compressor stopped if the liquid flow exceeds a predetermined threshold.

It is an object of this invention to provide compressor protection from liquid hazards.

It is another object of this invention to detect the flow of liquid refrigerant into a compressor.

It is a further object of this invention to provide a method for operating a refrigeration or air conditioning system so as to minimize liquid hazards for the accomplished by the present invention.

Basically, two liquid levels are sensed in the oil sump of a compressor to determine if sufficient oil and excess refrigerant are present prior to string the compressor and appropriate steps are taken, if necessary. At start-up, and during operation, the presence or flow of liquid refrigerant in the suction of the compressor is sensed and appropriate steps taken, if necessary.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
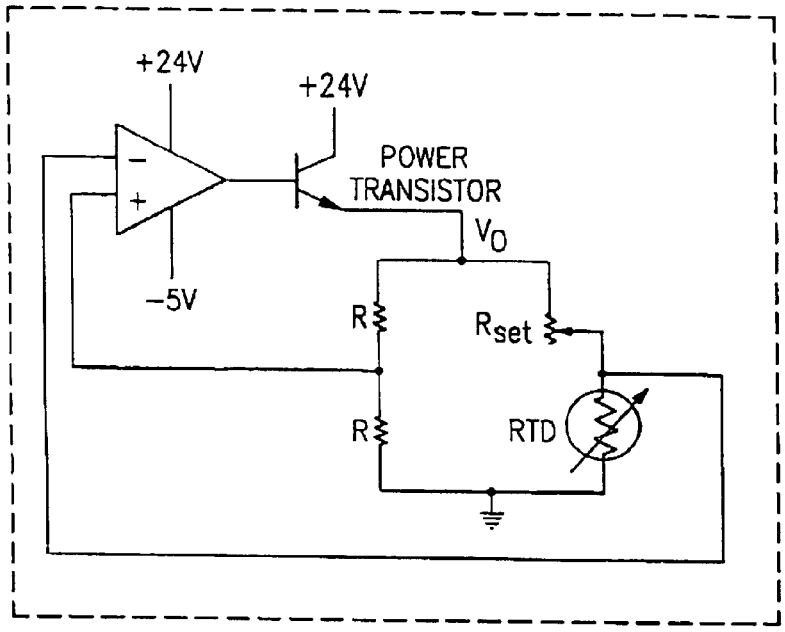
FIG. 1 illustrates a suitable sensor and its circuit.
Figure 2:
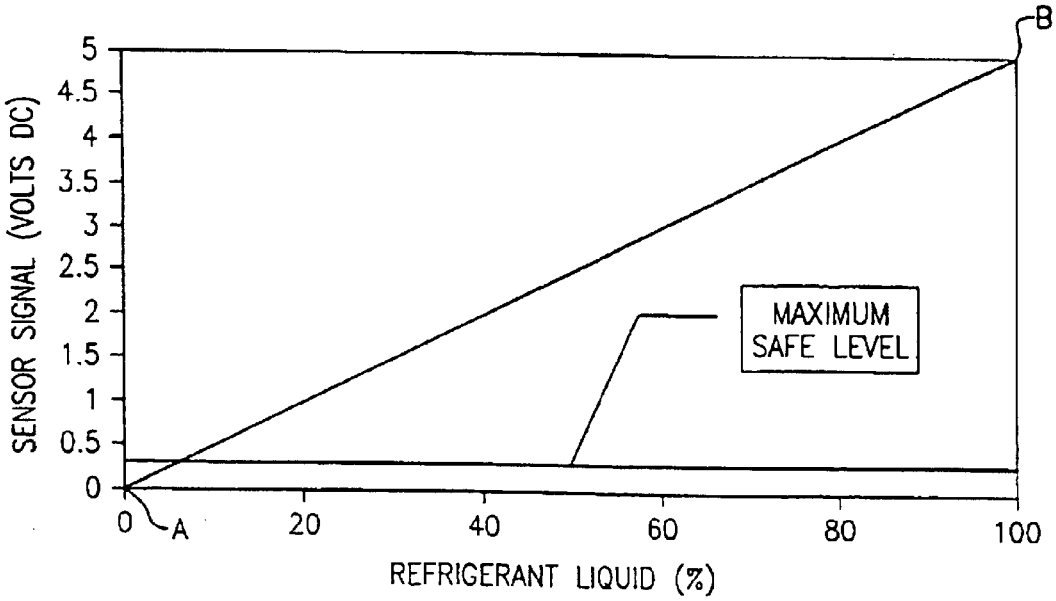
FIG. 2 is a plot of sensor signal vs. percentage of liquid for the sensor of FIG. 1.

FIG. 1 corresponds to FIG. 2 of the SAE journal article entitled "A or Estimating the Liquid Mass Fraction of the Refrigerant Exiting an Evaporator" authored by James Solberg, Norman R. Miller and Predrag Hrnjak. The article indicates that the circuit illustrated in FIG. 1 "tries to keep the resistance of the" resistance temperature detector, RTD, "equal to $R_{set}$" which is the RTD resistance. "The circuit uses an operational amplifier as the medium for feedback. The op-amp uses the feedback to maintain its inputs at constant voltage while drawing very little current. This is what forces the resistance of the RTD to be equal to the resistance of $R_{set}$. Traditionally, an RTD is used to measure temperature by measuring the resistance of the RTD as it changes with temperature. But, this circuit forces the resistance of the RTD to be equal to $R_{set}$. The circuit compensates by heating up the RTD until the resistance (and thus the temperature) of the RTD is equal to $R_{set}$."

In operation, "(a)s a droplet of saturated liquid refrigerant clings to the surface of the RTD, the RTD circuitry will do what it can to raise its temperature back (to) its set point (which is determined by $R_{set}$. To do this the RTD must transfer enough energy to the refrigerant to overcome its latent heat of vaporization. As the LMF (liquid-mass-fraction) of the fluid decreases, less energy is dissipated through the RTD. When the fluid becomes all vapor, all of the energy flux through the RTD point."

The sensor and circuit of FIG. 1 operates differently in the present invention than the operation described in the article in that it is used to detect liquid level indicative of insufficient lubricant and the presence of liquid and/or dissolved refrigerant in the oil prior to operation of the compressor/system. Additionally, the sensor and circuit of FIG. 1 is used to detect the presence of liquid in the suction of the compressor prior to operation of the compressor/system as well as during operation.

The response of the sensor and circuit of FIG. 1 is shown in FIG. 2. The line labeled "maximum safe level" represents the maximum acceptable amount of liquid. The sensor would not distinguish between liquid refrigerant and/or oil. If the sensor was solely in vapor, the response would be that of point A, the origin. If the sensor was in liquid refrigerant and/or oil, the response would be that of point B. The response indicated by the line between points A and B represents the range between 100% vapor and 100% liquid and represents the range of possible conditions at the suction of the compressor.

Figure 3:
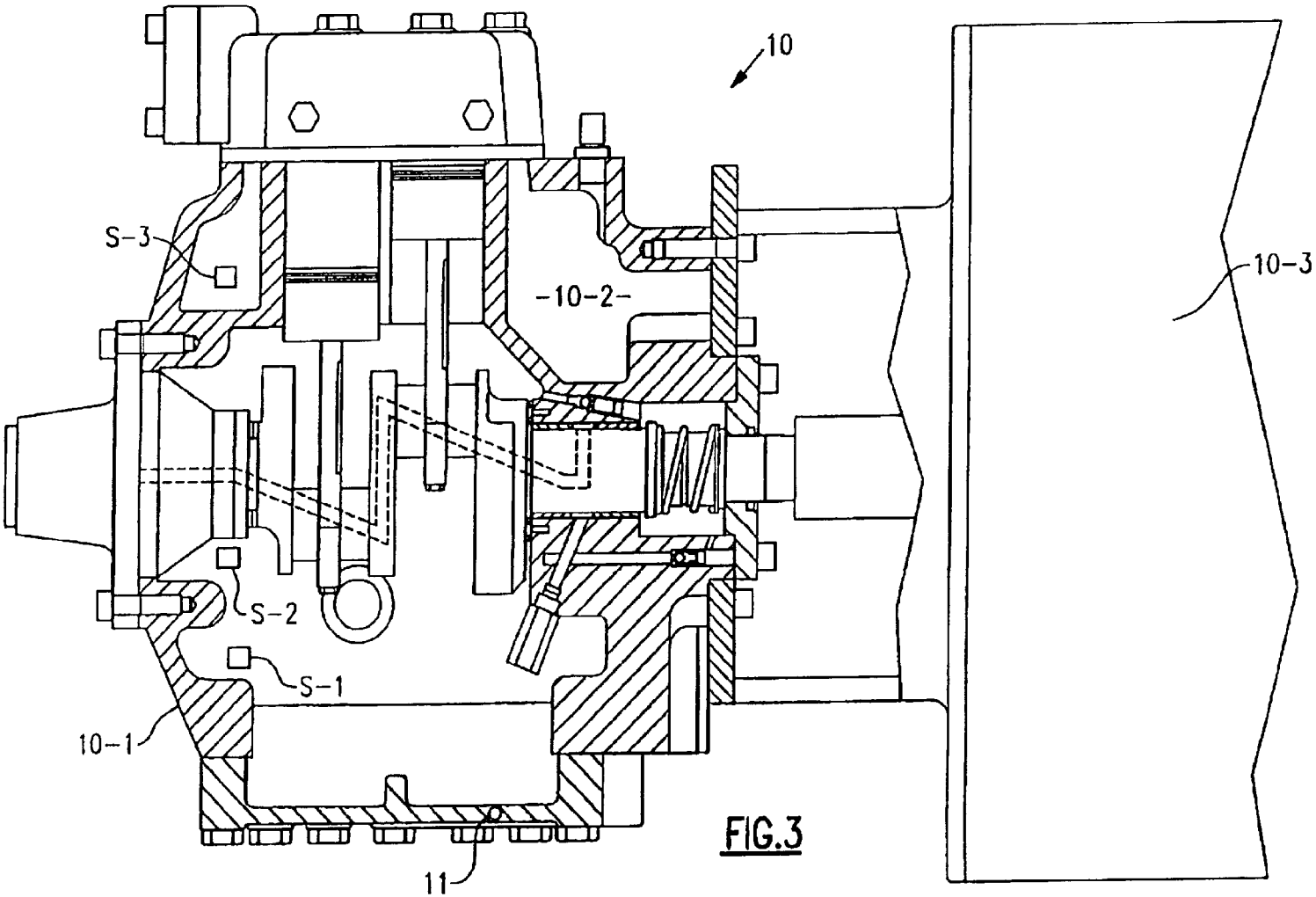
FIG. 3 illustrates a reciprocating compressor employing the present invention.

Referring specifically to FIG. 3, compressor 10 is a reciprocating compressor having a housing 10-1 defining a crankcase which is at suction pressure during operation. Three sensors S-1, S-2 and S-3 are located in compressor 10. Sensors S-1, S-2 and S-3 can be the same as the sensor of FIG. 1 and have the associated circuitry. Sensor S-1 is located at a lower level of the crankcase of compressor 10 at a level associated with a minimum acceptable oil level in the oil sump at the bottom of the crankcase. Normally, sensor S-1 will sense conditions corresponding to point B in FIG. 2. Sensor S-2 is located in the crankcase of compressor 10 at a location above the normal sump oil level. Accordingly, sensor S-2 may or may not be located in liquid. If sensor S-2 is in liquid, the most probable cause is the presence of liquid refrigerant and the sensor will sense conditions evaporate enough liquid refrigerant to lower the liquid level in the sump such that S-2 is above the liquid and will sense conditions corresponding to point A in FIG. 2.

Sensor S-3 is located in the suction manifold 10-2 of compressor 10. Sensor S-3 is used to sense the presence of liquid refrigerant prior to starting compressor 10 or the flow of liquid refrigerant into compressor 10 during operation. Sensor S-3 will determine the degree of liquid refrigerant present. If liquid is sensed by sensor S-3 at start-up, the crankcase heater 11 will be activated to evaporate the liquid refrigerant at the suction of the compressor. This is possible because the suction of the compressor is in fluid communication with the crankcase which is being heated. Typically, the presence of liquid, at start-up, will have sensor S-3 sensing conditions corresponding to those at, or near, point B of FIG. 2. During compressor operation, sensor S-3 should be sensing conditions corresponding to those between the line labeled "maximum safe level" and those at, or near, point A of FIG. 2. A small percentage of liquid refrigerant, indicated by the line labeled "maximum safe level" can be tolerated but the present invention stops the compressor before it can attempt to compress a significant amount of liquid.

Figure 4:
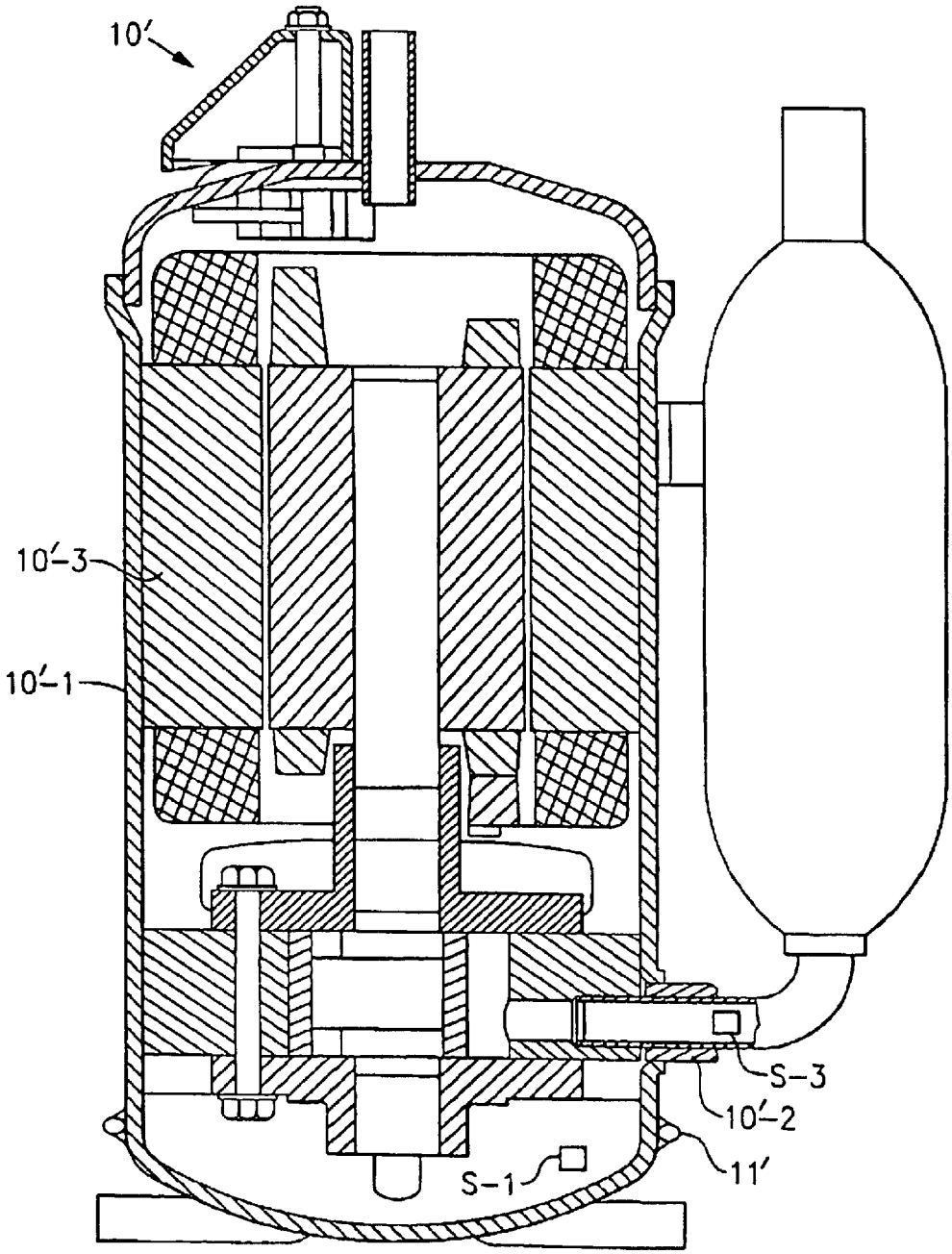
FIG. 4 illustrates a high side rotary compressor employing the present invention.

Referring specifically to FIG. 4, compressor 10' has a motor 10'-3 and is at discharge pressure during operation and there is no suction plenum. Because there is no crankcase, the sump volume is little more than the volume required for the lubricant. Accordingly, an excess volume of oil/refrigerant would go around and above the pump structure so that the sensor corresponding to S-2 of FIG. 3 is eliminated. Crankcase heater 11' is located as a band on the outer portion of casing 10'-1 in a region corresponding to the location of the oil sump. Sensor S-3 is located in suction 10'-2. Sensors S-1 and S-3 function in the same manner as the corresponding sensors in FIG. 3.

Figure 5:
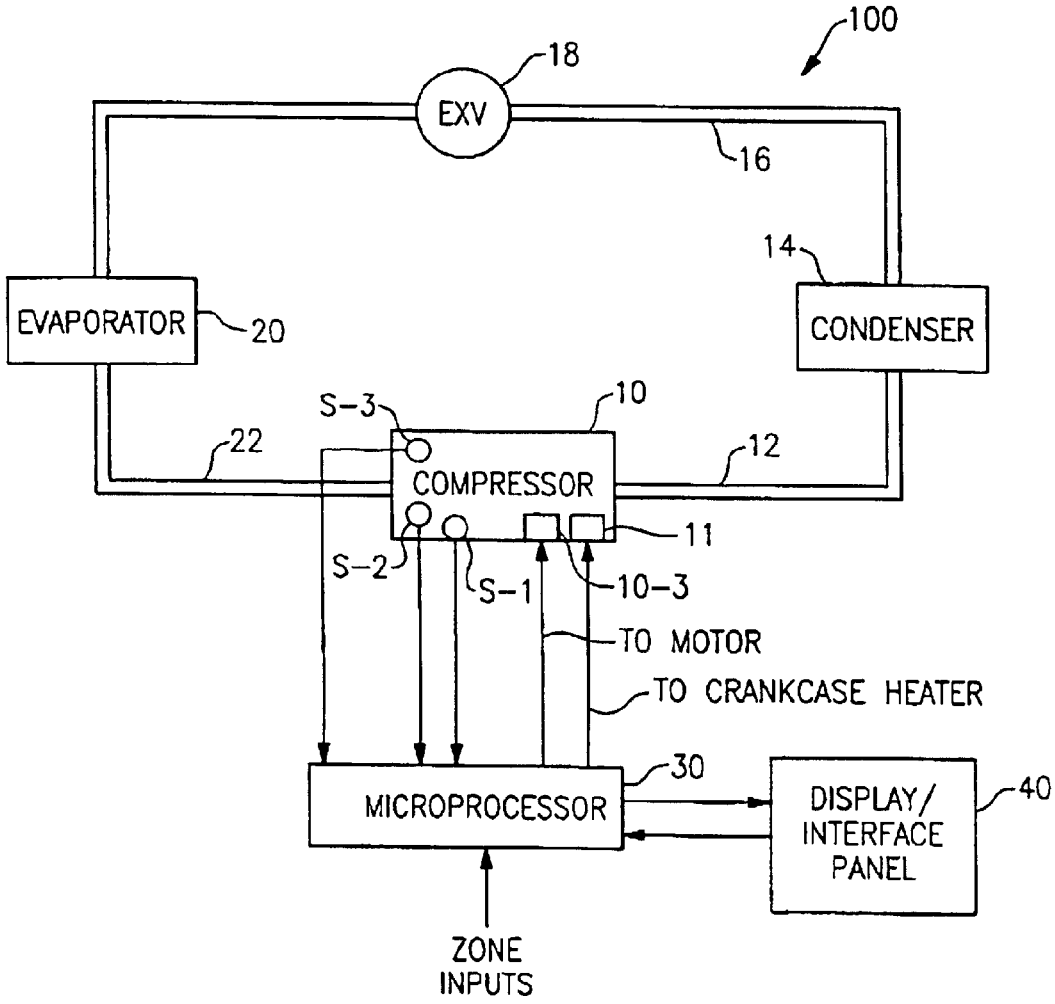
FIG. 5 is a schematic representation of a refrigeration or air conditioning system employing the present invention.

In FIG. 5, the numeral 100 generally designates a refrigeration or air line 12, condenser 14, line 16 containing expansion device 18, evaporator 20 and suction line 22. Refrigeration or air conditioning circuit 100 is controlled by microprocessor 30. Taking FIGS. 3 and 5 together, microprocessor 30 is actively connected to sensors S-1, S-2 and S-3 as well as the compressor motor 10-3 and crankcase heater 11. Microprocessor 30 also receives a number of inputs such as the sensed ambient temperature, condenser entering air temperature, zone temperature and zone set point which are collectively labeled as zone inputs. Microprocessor 30 is connected in a two-way communication with display/interface panel 40.

Figure 6:
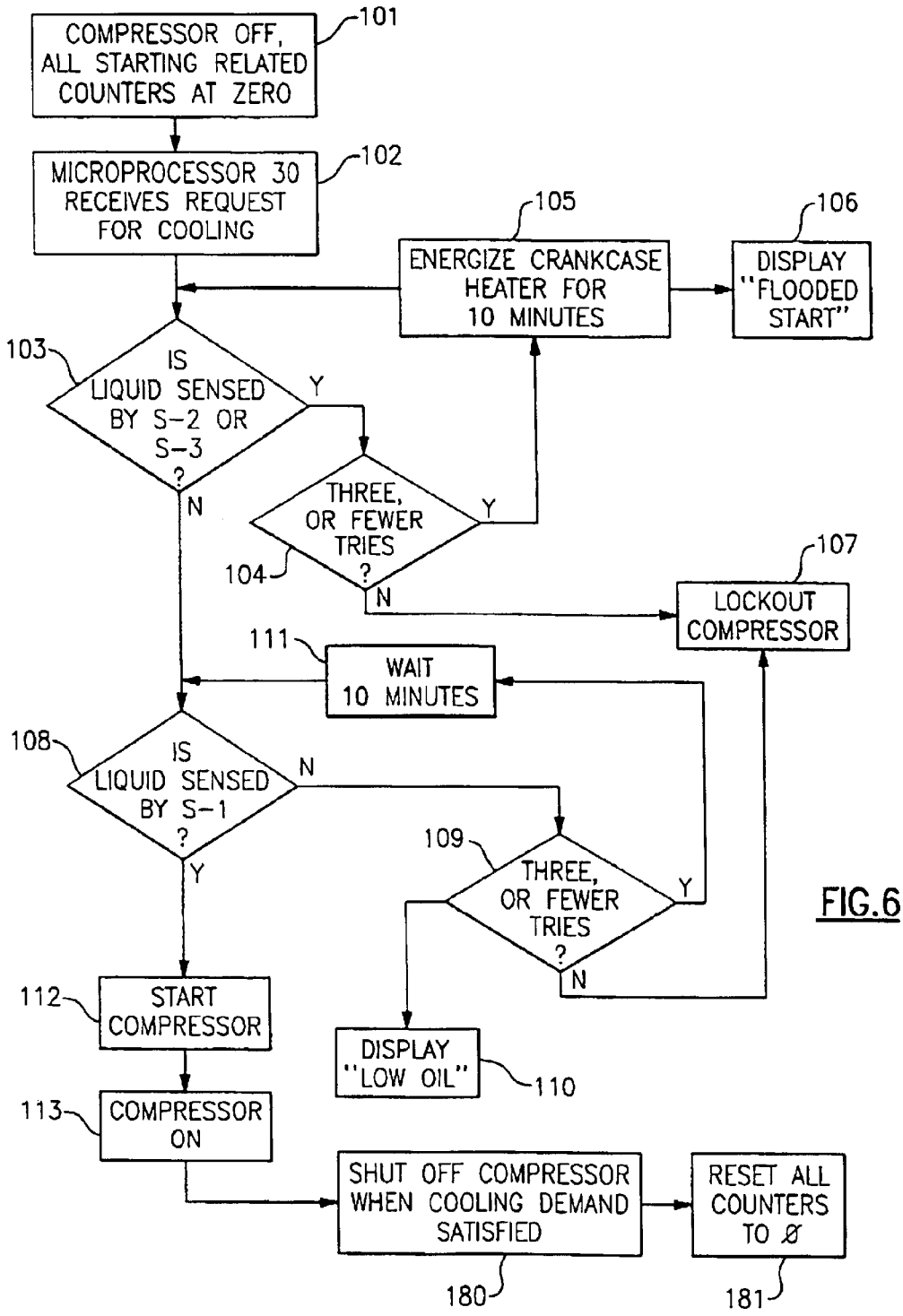
FIG. 6 is a flow diagram for starting the compressor.

The sequence for starting the compressor 10 so as to provide compressor protection according to the teachings of the present invention is illustrated in FIG. 6. With compressor 10 off and all starting related counters set to zero, as indicated by block 111, the receipt of a request for cooling by microprocessor 30, as indicated by block 102 initiates a start-up procedure. There is an affinity between oil and refrigerant such that they are miscible, and the presence of liquid refrigerant raises the level in the sump. The presence or absence of liquid will be sensed by sensors S-2 and S-3, as indicated block 103. Sensor S-2 may be in or above the liquid in the sump depending upon how much liquid is present in the sump. Sensor S-3 will sense any liquid present at the suction inlet of the compressor 10. If either sensor S-2 or S-3 senses liquid, and there have been three, or fewer, start-up tries, as indicated by block 104, the crankcase heater is run for 10 minutes, as illustrated by block 105, and "flooded start" is displayed on the display panel as indicated by block 106. After the crankcase heater has run for 10 minutes, you return to block 103. After three unsuccessful heating cycles, the compressor is locked out as indicated by block 107. When the compressor is locked out as indicated by block 107, it takes a manual intervention before an attempt can be made to start compressor 10. If no liquid is sensed by sensors S-2 or S-3 initially, or after one to three crankcase heating cycles, the liquid level is sensed by sensor S-1 as indicated by block 108. If no liquid is sensed by sensor S-1, the oil level is too low and, if there have been three, or fewer start-up tries as indicated by block 109, "low oil" is displayed on the display panel as into the compressor sump, as indicated by block 111, before returning to block 108. After three waiting cycles, the compressor is locked out as indicated by block 107. If the liquid level sensed initially by sensor S-1 or after one to three waiting cycles is okay, the compressor is started as indicated by block 112. Since sensors S-1, S-2 and S-3 must each be satisfied prior to starting compressor 10, the satisfaction of sensor S-1 may, if desired, take place prior to the satisfaction of sensors S-2 and S-3.

Once the compressor 10 is started and running, as indicated by block 113, the operation of the evaporator will dictate whether or not liquid refrigerant is supplied to the suction of the compressor. The oil level in the sump will vary responsive to oil being carried through the system by the refrigerant and its rate of return. Accordingly, sensors S-1, S-2 and S-3 are continuously monitored during the operation of the system 100. Although the sensors S-1, S-2 and S-3 are continuously monitored, the sensor S-3 is the most time sensitive. Assuming a motor operating at 3600 RPM, one revolution corresponds to 1/60 of a second. With sensor S-3 being capable of being monitored at one millisecond intervals, a series of readings can be taken to determine the nature of the liquid and still stop the compressor prior to completing a revolution of the motor and the corresponding pumping cycle of the compressor. During operation, liquid at the suction can take two forms. The first would be a continuous flow of liquid at a rate above the "maximum safe level" indicated in FIG. 2 and is known as flooding. The second would be a discrete flow of all, or mostly, liquid and is known as slugging.

Once the compressor 10 is on, as indicated by block 113, each of the sensors S-1, S-2 and S-3 will be continuously sensed and periodically monitored and each will initiate its own response upon the sensing of a specific condition.

Figure 7:
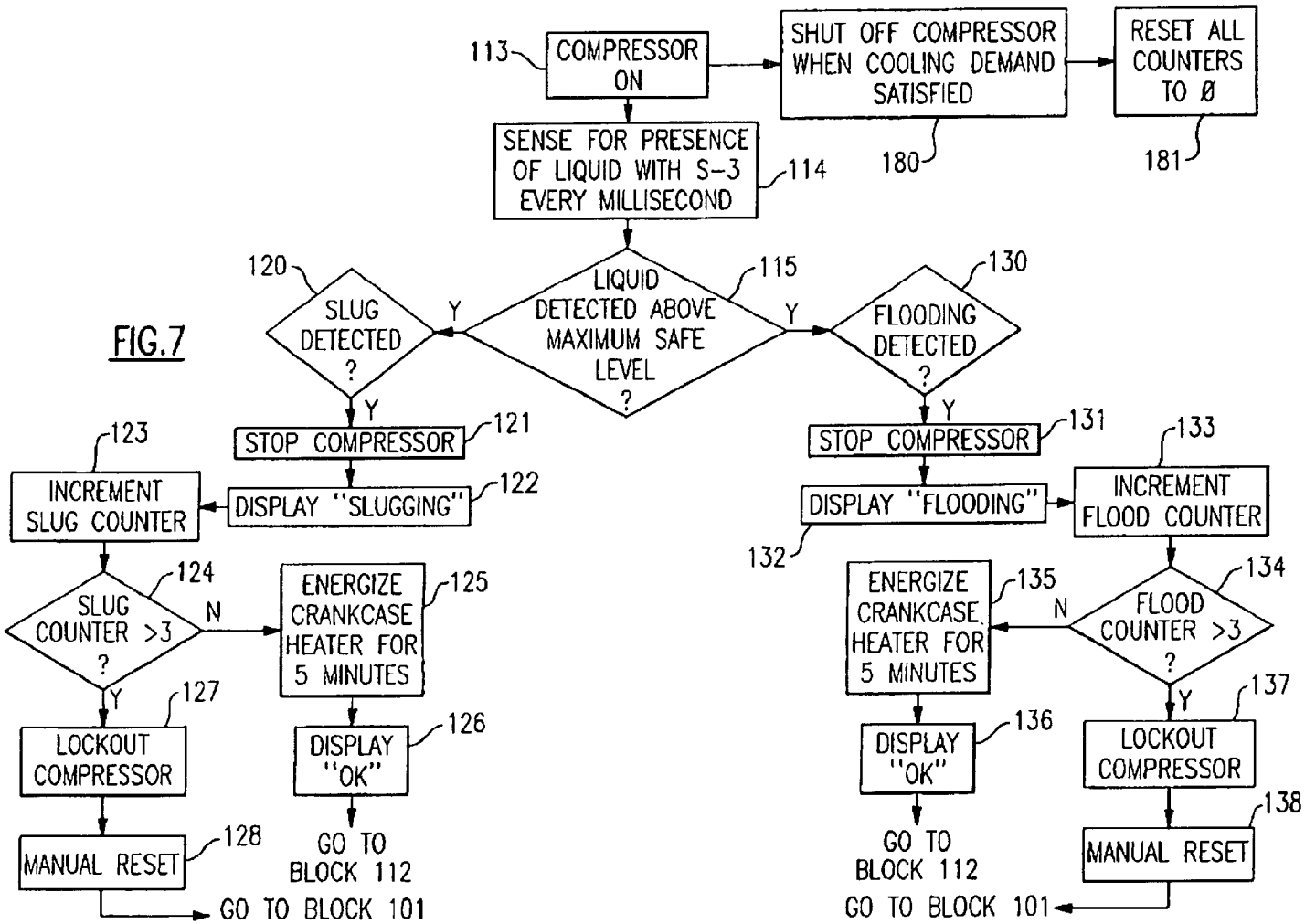
FIG. 7 is a flow diagram for operating the compressor after starting responsive to sensor S-3.

Referring specifically to FIG. 7, with the compressor running, as indicated by block 113, the sensor S-3 will test for the presence of liquid in the suction plenum or suction inlet of the compressor every millisecond, as indicated by sensed by sensor S-3 may represent an amount no greater than the "maximum safe level" indicated on FIG. 2 which would require no corrective action. If the amount of liquid sensed by sensor S-3 is in excess of the "maximum safe level" then corrective action is required. Because sensor S-3 is monitored every millisecond a number of sensor inputs can be received prior to responding while permitting a response within the 1/60 of a second representing one revolution of the motor and one cycle of the pump structure of the compressor. With the detection of liquid above the "maximum safe level" by sensor S-3 a number of sensor inputs will be considered in block 115 and a determination made as to whether the sensed liquid represents a slug or flooding. If a slug is detected in block 115 you go to block 120 and if flooding is detected in block 115 you to go block 130. The response to the detection of a slug or flooding is pretty much the same except for displaying the specific fault. The different messages will help a repair person to identify and fix the cause of the problem more effectively. If a slug is detected or if flooding is detected, the compressor is stopped as indicated by blocks 121 and 131, respectively. If the compressor is stopped for slugging, "slugging" is displayed, as indicated by block 122, and the slug counter is incremented, as indicated by block 123. If three, or fewer, slugs have been encountered responsive to the current request for cooling, as indicated by block 124, the crankcase heater 11 is energized for five minutes, as indicated by block 125. After the crankcase heater 11 has been energized for five minutes, "OK" is displayed, as indicated by block 126 and you go back to block 112 to start the compressor 10 which may include up to two more cycles of crankcase heating. After four slugs have been encountered responsive to the current request for cooling, as indicated by block 124, the compressor is locked out, as indicated by block 127. With the compressor locked out, as indicated by block 127, the lockout can be removed by a manual reset, as indicated by block 128. When a manual reset takes place, as indicated by block 128, you go back to block 101.

If the compressor is stopped for flooding, "flooding" is displayed, as indicated by block 132, and the flood counter is incremented, as indicated by block request for cooling, as indicated by block 134, the crankcase 11 heater is energized for five minutes, as indicated by block 135. After the crankcase heater 11 has been energized for five minutes, "OK" is displayed, as indicated by block 136 and you go back to block 112 to start the compressor 10 which may include up to two more cycles of crankcase heating. After four floodings have been encountered responsive to the current request for cooling, as indicated by block 134, the compressor is locked out, as indicated by block 137. With the compressor locked out, as indicated by block 137, the lockout can be removed by a manual reset, as indicated by block 138. When a manual reset takes place, you go back to block 101.

Figure 8:
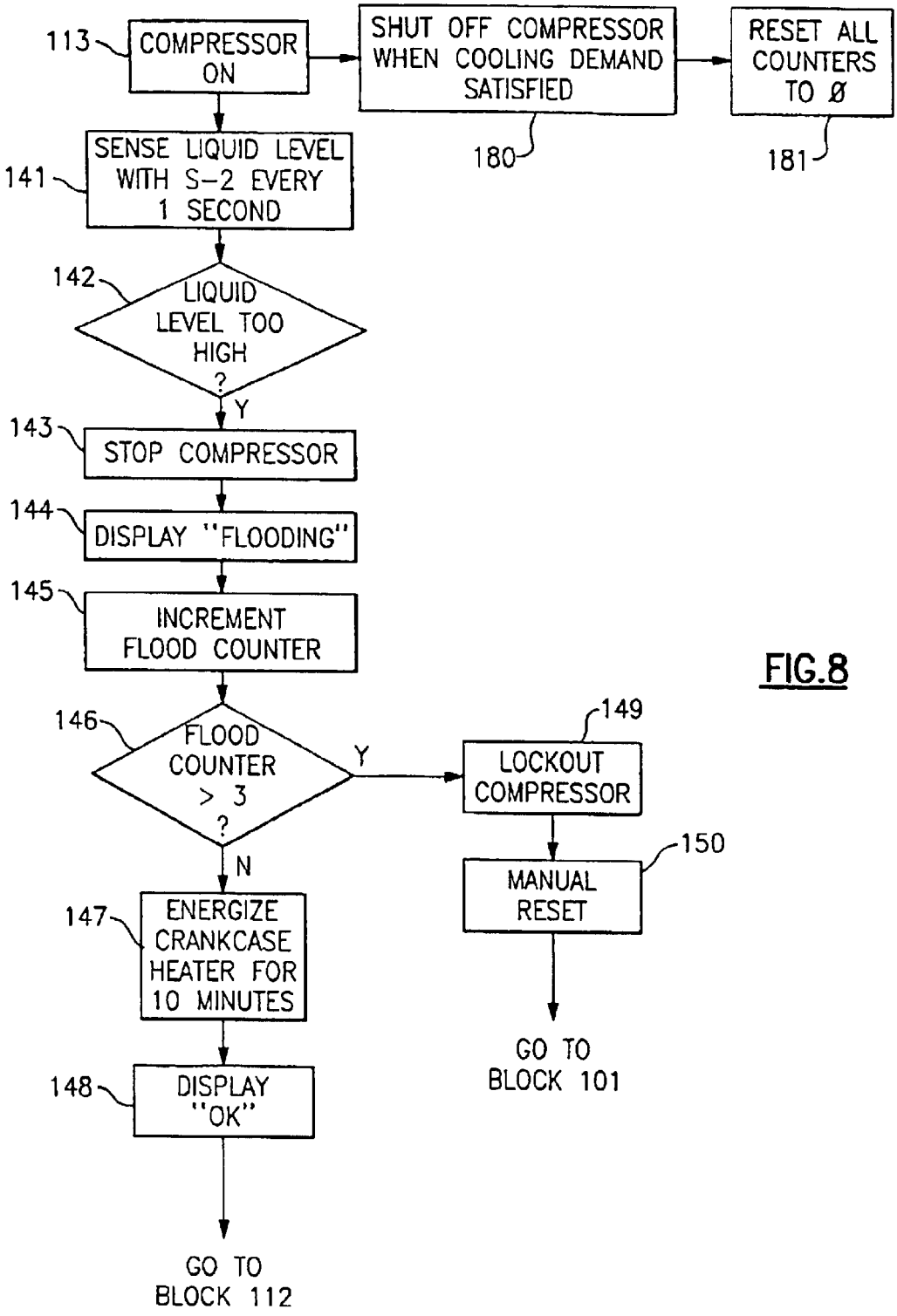
FIG. 8 is a flow diagram for operating the compressor after starting responsive to sensor S-2.

The compressor can only be started if sensor S-2 is above the liquid/oil in the sump of the compressor. Referring specifically to FIG. 8, with the compressor running, as indicated by block 113, sensor S-2 will sense the presence or absence of liquid at a level in the sump corresponding to excess liquid, as indicated by block 141. The presence or absence of liquid sensed by sensor S-2 at the predetermined level will be made each second and the sensor information supplied to block 142 where the sensing of liquid by sensor S-2 is indicative of a liquid level that is too high thereby indicating too much refrigerant in the sump and oil: dilution. Responsive to a determination of a liquid level that is too high, as indicated by block 142, the compressor is stopped as indicated by block 143. With the compressor stopped for flooding, "flooding" is displayed, as indicated by block 144, and the flood counter is incremented, as indicated by block 145. If three, or fewer, floods have been encountered responsive to the current request for cooling, as indicated by block 146, the crankcase heater 1I is energized for ten minutes, as indicated by block 147. After the crankcase heater has been energized for ten minutes, "OK" is displayed, as indicated by block 148, and you go back to block 112 to start the compressor which may include up to two more cycles of crankcase heating. After four floodings have been encountered responsive to the current request for cooling, as indicated by block 146, the compressor is locked out, as indicated by block 149. With the compressor locked out, as indicated by block 149, the lockout can be removed by a manual reset, 150, you go back to block 101.

Figure 9:
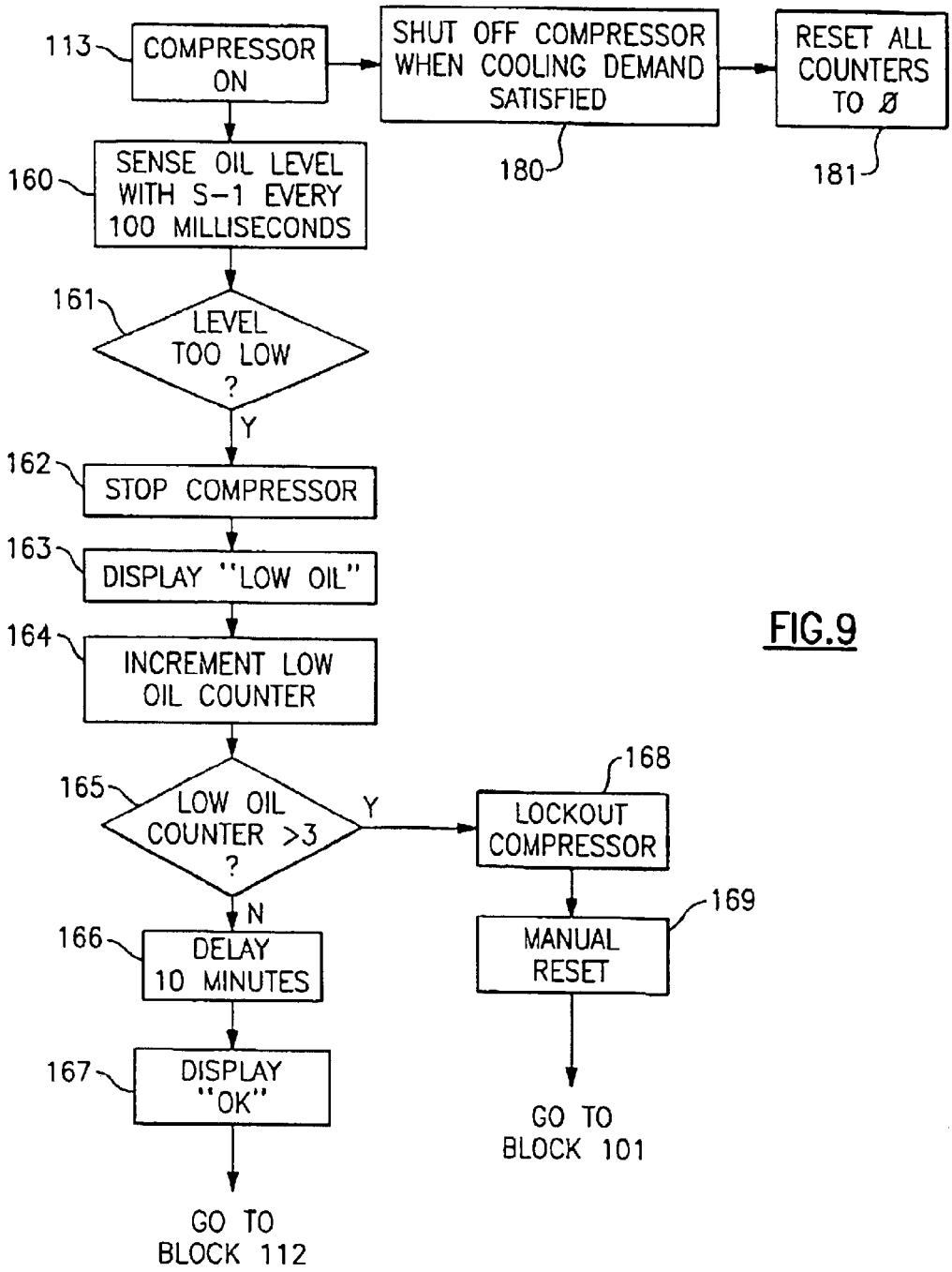
FIG. 9 is a flow diagram for operating the compressor after starting responsive to sensor S-1.

The compressor can only be started if sensor S-1 is in liquid in the sump. This insures that, if the liquid is oil, there is sufficient oil for lubrication. Since some of the liquid may be refrigerant it may boil off and lower the liquid level below sensor S-1. Oil may also be pumped out of the compressor lowering the liquid level below sensor S-1. Referring specifically to FIG. 9, with the compressor running, as indicated by block 113, the sensor S-1 will sense the presence or absence of liquid at a level in the sump corresponding to a minimum sump liquid level, as indicated by block 160. The presence or absence of liquid sensed by sensor S-1 at the predetermined level will be made each one hundred milliseconds and the sensor information supplied to block 161 where the failure to sense liquid by sensor S-1 is indicative of a too low of a liquid level and insufficient oil in the sump. If too low of a liquid level is determined in block 161, the compressor is stopped, as indicated by block 162. With the compressor stopped for low oil, "low oil" is displayed, as indicated by block 163, and the low oil counter is incremented, as indicated by block 164. If three, or fewer, low liquid level occurrences have been encountered responsive to the current request for cooling, as indicated by block 165, a time delay often minutes, as indicated by block 166, takes place to permit oil to drain back to the sump. After the elapse often minutes, "OK" is displayed, as indicated by block 167 and you go back to block 112 to start the compressor which may include up to two more ten minute time delays. After four low oil sensings have been encountered responsive to the current request for cooling, as indicated by block 165, the compressor is locked out, as indicated by block 168. With the compressor locked out, as indicated by block 168, the lockout can be removed by a manual reset, as indicated by block 169. When a manual reset takes place, as indicated by block 169, you go back to block 101.

With the compressor on, as indicated by block 113 in FIGS. 6 though 9, the satisfaction of the cooling demand will result in the shutting off of the compressor, block 181.

Although preferred embodiments of the present invention have been illustrated and described, other changes will occur to those skilled in the art. For example, high side compressors such as illustrated in FIG. 4 have no requirement for sensor S-2. Because the starting cycle includes time delays and crankcase heating, the crankcase heating and delays may be eliminated other than in the starting cycle. The various time periods may be changed as long as the compressor can be stopped within one rotation for flooding or slugging. It is therefore intended that the scope of the present invention is to be limited only by the scope of the appended claims.

What is claimed is:

1. In an air conditioning system under the control of a microprocessor and including a positive displacement compressor having a suction inlet, a motor, an oil sump and a crankcase heater, means for protecting said compressor operatively connected to said microprocessor and including:

means for sensing the percentage of liquid present at said suction inlet, means for preventing the starting of said compressor when said means for sensing the percentage of liquid detects at least a predetermined percentage of liquid;

means for stopping said compressor when said means for sensing the percentage of liquid detects at least a predetermined percentage of liquid;

means for activating said crankcase heater at least one time after said means for sensing the percentage of liquid detects at least a predetermined percentage or liquid; and means for attempting starting said compressor after said crankcase heater has been activated.

2. The means for protecting said compressor of claim 1 further including:

first means for sensing the presence or absence of liquid at a first predetermined level in said sump wherein said first level is indicative of a minimum acceptable oil level in said sump; and means for preventing the starting of said compressor when said first means senses the absence of liquid at said first predetermined level.

3. The means for protecting said compressor of claim 2 further including:

means for stopping said compressor when said first means senses the absence of liquid at said first predetermined level.

4. The means for protecting said compressor of claim 2 further including:

second means for sensing the presence or absence of liquid at a second predetermined level in said sump wherein said second level is above said first level and is indicative of an excess of liquid in said sump;

means for preventing the starting of said compressor when said second means senses the presence of liquid at said second predetermined level;

means for stopping said compressor when said second means senses the presence of liquid at said second predetermined level;

means for activating said crankcase heater at least one time after said second mans senses the presence of liquid at said second level; and means for attempting starting said compressor after said crankcase heater has been activated.

5. The means for protecting said compressor of claim 1 further including:

means for sensing the presence or absence of liquid at a predetermined level in said sump wherein said predetermined level is indicative of an excess of liquid in said sump;

means for preventing the starting of said compressor when said means for sensing the presence or absence of liquid senses the presence of liquid at said predetermined level;

means for stopping said compressor when said means for sensing the presence or absence of liquid senses the presence of liquid at said predetermined level;

means for activating said crankcase heater at least one time after said means for sensing the presence or absence of liquid senses the presence of liquid at said predetermined level; and means for attempting staring said compressor after said crankcase heater has been activated.

6. In an air conditioning system under the control of a microprocessor and including a positive displacement compressor having a suction inlet, a motor, an oil sump and a crankcase heater, mean for protecting said compressor operatively connected to said microprocessor and including:

first means for sensing the presence or absence of liquid at a first predetermined level in said sump wherein said first level is indicative of a minimum acceptable oil level in said sump;

second means for sensing the presence or absence of liquid at a second predetermined level in said sump wherein said second level is above said first level and is indicative of an excess of liquid in said sump;

means for preventing the starting of said compressor when said first means senses the absence of liquid at said first predetermined level;

means for preventing the starting of said compressor when said second means senses the presence of liquid at said second predetermined level;

means for stopping said compressor when said second means senses the presence of liquid at said second predetermine level means for activating said crankcase heater at least one time after said second means senses the presence of liquid at said second level; and means for attempting starting said compressor after said crankcase heater has been activated.

7. The means for protecting said compressor of claim 6 further including:

means for stopping said compressor when said first means senses the absence of liquid at said first predetermined level.

8. A method for operating an air conditioning system which is under the control of a microprocessor and including a positive displacement compressor having a suction inlet, a motor, an oil sump and a crankcase heater, a method for protecting said compressor including the steps of:

sensing the percentage of liquid present at said suction inlet;

preventing the starting of said compressor when liquid in excess of a predetermined percentage is sensed at said suction inlet;

stopping said compressor when liquid in excess of a predetermined percentage is sensed at said suction inlet;

activating said crankcase heater at least one time after liquid in excess of a predetermined percentage is sensed at said suction inlet; and attempting starting said compressor after said crankcase heater has been activated.

9. The method of claim 8 further including the steps of:

sensing the presence or absence of liquid at a first predetermined level in said sump which is indicative of a minimum acceptable oil level in said sump; and preventing the starting of said compressor when the absence of liquid is detected at said first level.

10. The method of claim 9 further including the step of:

stopping said compressor when the absence of liquid is detected at said first level.

11. The method of claim 9 further including the steps of:

sensing the presence or absence of liquid at a second predetermined level in said sump wherein said second level is above said first level and is indicative of an excess of liquid in said sump;

preventing the starting of said compressor when the presence of liquid is sensed at said second level;

stopping said compressor when the presence of liquid is sensed at said second level;

activating said crankcase heater when the presence of liquid is sensed at said second level;

attempting starting said compressor after said crankcase heater has been activated.

12. The method of claim 8 further including the steps of:

sensing the presence or absence of liquid at a predetermined level in said sump wherein said predetermined level is indicative of an excess of liquid in said sump;

preventing the starting of said compressor when the presence of liquid is sensed at said predetermined level;

stopping said compressor when the presence of liquid is sensed at said predetermined level;

activating said crankcase heater when the presence of liquid is sensed at said predetermined level;

attempting star said compressor after said crankcase heater has been activated.

* * * * *